US005456444A

United States Patent [19]

Wegman

[11] Patent Number: 5,456,444

[45] Date of Patent: Oct. 10, 1995

[54] CONCRETE FORM WALL ASSEMBLIES AND METHODS

[76] Inventor: Paul R. Wegman, 1042 Cypress, Aurora, Ill. 60506

[21] Appl. No.: 927,328

[22] Filed: Aug. 10, 1992

[51] Int. Cl.[6] ..... E04G 11/10; E04G 17/14

[52] U.S. Cl. ..... 249/40; 249/45; 249/47; 249/191; 249/192; 249/194; 249/195; 249/196; 249/210

[58] Field of Search ..... 249/40, 41, 45, 249/47, 189, 191, 192, 194, 195, 196, 210, 219.2

[56] References Cited

U.S. PATENT DOCUMENTS

| | | | |
|---|---|---|---|
| 3,035,321 | 5/1962 | Hennig | 249/45 |
| 3,055,076 | 9/1962 | Van Helden et al. | 249/45 |
| 3,141,224 | 7/1964 | Gates | 249/210 |
| 3,432,137 | 3/1969 | Krajco | 249/45 |
| 3,450,380 | 6/1969 | Fontaine | 249/45 |
| 4,062,514 | 12/1977 | Scott-King | 249/45 |
| 4,168,052 | 9/1979 | Calderaro | 249/210 |
| 4,239,173 | 12/1980 | Sawyer | 249/45 |

OTHER PUBLICATIONS

"Concrete Forming System", Rapid-form Co. Inc.

"Faster and better forming than ever before with Gates Cam-Lock Forming System", Gates & Sons, Inc. 20 page booklet, Updated Jul. 1987.

"A new generation in Aluminium Forming Systems" Western Forms, Inc. 11 pages, 1988.

"Gates Horizontal Rod Panel System—Solid Concrete Foundations how to do it . . . Step By Step" Gates & Sons, Inc., 1990.

*Primary Examiner*—James P. Mackey

*Attorney, Agent, or Firm*—Potthast & Ring

[57] ABSTRACT

A wall form assembly (10, 10", 10'") has a pair of form wall assemblies (12A, 12B) which are kept in preselected spaced parallel relationship by means of cross members (16) fitted within end slots (36) and interlocked by means of pins (38) with elongate braces (30) mounted for movement from a low profile position for transport to a high profile operative position in which the width dimension (32) is transverse to the plane of the form wall (18–22B) for maximum resistance to bowing from the hydrostatic forces of wet cement.

23 Claims, 6 Drawing Sheets

CONCRETE FORM WALL ASSEMBLIES AND METHODS

BACKGROUND OF THE INVENTION

1. Field of the Invention

This invention relates to a concrete wall form assembly, or system, and method of assembling same and, more particularly, to such a concrete wall form assembly which is adapted for portability.

2. Description of the Related Art Including Information Disclosed Under 35 CFR 1.97–1.99

Concrete wall form assemblies comprising a plurality of interconnectable plywood panels or form walls which are interconnected at the job site to make a wall form are well known. Because of the substantial hydrostatic pressure of wet premixed concrete tending to forceably separate opposed sections of a concrete wall form, it is known to provide mechanisms to tie together the opposed walls to resist form wall separation. The hydrostatic pressure also tends to flex, or bow out, the form walls or form wall panels, and for this reason it is known to reinforce the form wall panels against bowing with elongate metal braces. After the concrete has been set, the concrete wall form is disassembled and moved for reuse at another job site.

All of these known concrete wall form systems suffer from one or more disadvantageous features with respect to the assembly of the tie mechanisms, the presence of movable parts which can break, the presence of loose parts which can be lost and excessive weight.

In some systems, the opposed wall sections are held together by numerous elongate ties located intermediate the ends of the sections and distributed across the surface such that two persons on opposite sides of the opposed sections are required to align and thread the ties through mating tie holes in the wall sections. It is not possible for one person to perform the assembly in this system. In another system, the ties are locked against removal by special cam locking parts which are not permanently connected to the wall sections or to the ties and can be lost. In another known system, the ties have loops through which must be threaded, steel reinforcing rods to position removal of the ties and which are also separable from the wall sections constitute loose parts which can be easily lost or misplaced when needed.

In a third known system, the ties are accessible at the edges of the form wall section but require a special steel pivotal locking mechanism at the ends of elongate steel braces fixedly mounted to the wall sections for holding the ties against separation from the form wall sections; the ties are necessary to interconnect contiguous sections, so it is not possible to mount the form wall panels end to end without simultaneously tying together the opposed parallel form wall panels.

Other problems associated with known concrete wall form systems are associated with the need to provide the wall forms with substantial rigidity to resist bowing in response to the hydrostatic pressure of the wet concrete. The functional requirement of strength has been achieved in all known form wall systems at the expense of excessive weight, excessive costs, or both. In the one system without braces, 1½ inch thick plywood is used to obtain the needed strength, but this causes excessive weight. In systems with metal braces, the thickness dimension of the braces is not elongate in a direction extending transversely away from the wall section for maximum resistance against bowing, and thus weight in the plywood and brace combination remains excessive. It is known to make form wall sections of all aluminum using aluminum frames but, because of the relative weakness of aluminum, excessive weight in the plywood and aluminum frame still results.

SUMMARY OF THE INVENTION

It is therefore the principal object of the present invention to provide a concrete wall form assembly and method of assembling same which overcomes the aforementioned disadvantages of known concrete form assemblies by providing form wall panels, or form walls, which are relatively light in weight for ease in handling during assembly and transport while remaining sufficiently strong to resist bowing and in which there are no loose parts except the replaceable ties that are left inside the concrete wall formed by the assembly and in which the ties are accessible from the ends of the opposed form walls and are not required for interconnecting the form walls in end to end relationship to enable assembly by a single worker.

This object is achieved by provision of a concrete wall form assembly having a form wall with interior and exterior surfaces, the improvement being a brace assembly, comprising an elongate brace and means for mounting the brace along the exterior surface of the form wall for movement between a collapsed relatively low profile position for transport and an operative position for bracing the form wall in which the mounting means includes means for pivotally mounting the brace for pivotal movement between the collapsed position and the operative position, the form wall has an end and the elongate brace has an end portion that extends beyond the end of the form wall to interconnect with a brace of another form wall and the end portion has a pin hole for pinned connection with a brace of another form wall.

The object of the invention is also achieved by providing a method of making a concrete wall form from a plurality of form walls, comprising the steps of (1) mounting braces to the form walls for movement between a relatively low profile collapsed position for transport and an operative position for bracing the form wall, (2) moving the braces to the collapsed position for transport of the form walls to a construction site, (3) transporting the form walls to the construction site with the braces in the collapsed position and (4) moving the braces from the collapsed position to the operative position at the job site to assemble the form walls into a concrete wall form.

Another object is achieved by provision of a concrete form wall assembly having a form wall with an end and interior and exterior surfaces with a cross bar assembly comprising a slot in the end of the form wall for snug supportive receipt of a cross member and means including an interlocking member adjacent to the slot on the exterior surface of the form wall for releasably preventing removal of the cross member from the slot. Preferably, the removal preventing means includes a brace member for reinforcing the form wall and having a pin hole for receipt of the pin member to interlock the brace member with the cross member and means for releasably connecting the interlocking member in the slot with another form wall.

The object is also achieved by provision of a method of making a concrete wall with first and second form walls having interior and exterior planar surfaces and rectilinear edges, comprising the steps of (1) setting up a first form wall with a cross member supportive slot in a vertical edge of the form wall, (2) setting up a second form wall in parallel with and spaced from the first form wall and with a cross member supportive slot in a vertical edge of the second form wall aligned with the slot of the first form wall, (3) inserting opposite ends of a cross member into the end slots of the first and second form walls respectively for supportive receipt therewithin and (4) releasably blocking removal of the cross members from the slots in a direction substantially transverse to the planar surfaces of the form walls while concrete is poured between the first and second form walls. Preferably, the step of blocking includes the step of passing a pin member through portions of the ends of the cross member located adjacent the outside surfaces of the first and second form walls, and the step of blocking includes the step of releasably interlocking the ends of the cross member to reinforcement members at the outer surface of the form walls.

Obtainment of the object of the invention is also achieved by providing a concrete form assembly having a form wall with an exterior surface and a pair of spaced opposite ends, an elongate brace member having a length greater than the spacing between the opposite ends and means for mounting the brace member to the exterior surface with an end portion extending beyond at least one of the opposite ends for interconnection with a mounting brace of another form wall assembly. In the preferred embodiment, the mounting means includes a pin for interconnection of the brace member with the mounting brace of another form wall assembly, and the mounting means includes means for interconnecting a cross member disposed between the form wall and another wall assembly.

The object is achieved in part by providing a concrete wall form assembly with a corner assembly having an interior corner formed by two walls interconnected at a right angle and each having a distal end and a plurality of aligned slots in each digital end for receipt of a cross member.

Also, the object of the invention is obtained by provision of a concrete wall form corner assembly with a first form wall, a second form wall connected to the first form wall to form an inside corner piece, a third form wall, an elongate brace carried by an exterior surface of a third form wall and extending beyond the third form wall and along one of the two walls of the corner piece into the interior corner for interconnection with a brace of another form wall and means for securing the third form wall to an end of the inside corner piece.

Still, the object of the present invention is achieved by providing a form wall for construction of a concrete wall form with a plurality of elongate braces having width dimensions greater than thickness dimensions and means for mounting the braces to the body with their width dimensions extending in a direction substantially transverse to the planar body.

The object of the invention is further achieved by providing a concrete wall form assembly having a pair of form walls with interior and exterior surfaces with a brace assembly comprising an elongate cross member for interconnecting the pair of form walls in preselected spaced relationship having an elongate body extending between a pair of end portions, each of said end portions having locking pin holes therein for receipt of locking pins to block separation of the cross member from interconnection with the pair of form walls to maintain them in said preselected spaced relationship and means carried by the form wall assembly for mounting the opposite end portions of the elongate cross member to the pair of form walls in interconnected relationship therewith.

Moreover, the object of the invention is achieved by provision of a concrete wall form assembly having a pair of form walls with interior and exterior surfaces with a brace assembly having a cross member with an elongate body extending between a pair of end portions for connection with the pair of form walls and means for preweakening the cross member at a position between the elongate body and the end portions to facilitate removal of the end portions and means for mounting the cross member to the pair of form walls.

Yet further, the object of the invention is achieved by providing a method of making a concrete wall comprising the steps of (1) mounting a cross member with an elongate body with opposed end portions separated by a preweakened section to a pair of walls to maintain them in a preselected spaced relationship, (2) pouring premixed wet concrete into the space between the pair of walls with the end portions protruding from the pair of walls, (3) after the concrete has hardened into a self supporting wall, removing the pair of walls from the self-supporting concrete wall and (4) breaking off the end portions protruding from the hardened self-supporting concrete wall and the elongate body at the preweakened section.

Still further, the object of the invention is achieved by providing a concrete wall form assembly having a form wall with an exterior surface and substantial straight bottom edge with a brace assembly comprising an elongate brace carrying a transverse locking pin member at one end and a pin receiving hole at an opposite end and means for mounting the elongate brace to the exterior surface in substantially parallel relationship to the bottom edge.

Also achieving the object of the present invention is provision of a method of assembling a plurality of interconnected wall panels to form a concrete wall form, comprising the steps of (1) abutting together a pair of panels and (2) moving a brace of one of the pair of panels carrying a locking member at one end from an inoperative position to an operative locking position with respect to a mating locking member carried at the end of a brace of the other one of the pair of panels.

The object is also achieved in part by provision of a concrete wall form assembly having a pair of form walls with an exterior surface with a brace assembly having a pair of elongate braces respective mounted to the pair of adjacent form walls, a pair of connectors extending transversely from opposed ends of the pair of elongate braces and means for releasably clipping the transversely extending connectors together against longitudinal separation.

Yet further, the object of the present invention is achieved by providing a concrete form wall assembly having a form wall with an exterior surface with a brace assembly having an elongate cross member with a pair of transverse locking members carried at opposite ends and an elongate brace mounted to the exterior surface and carrying means for trapping the transverse locking member in locking relationship with the brace.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which.

DESCRIPTION OF THE PREFERRED EMBODIMENT

Figure 1:
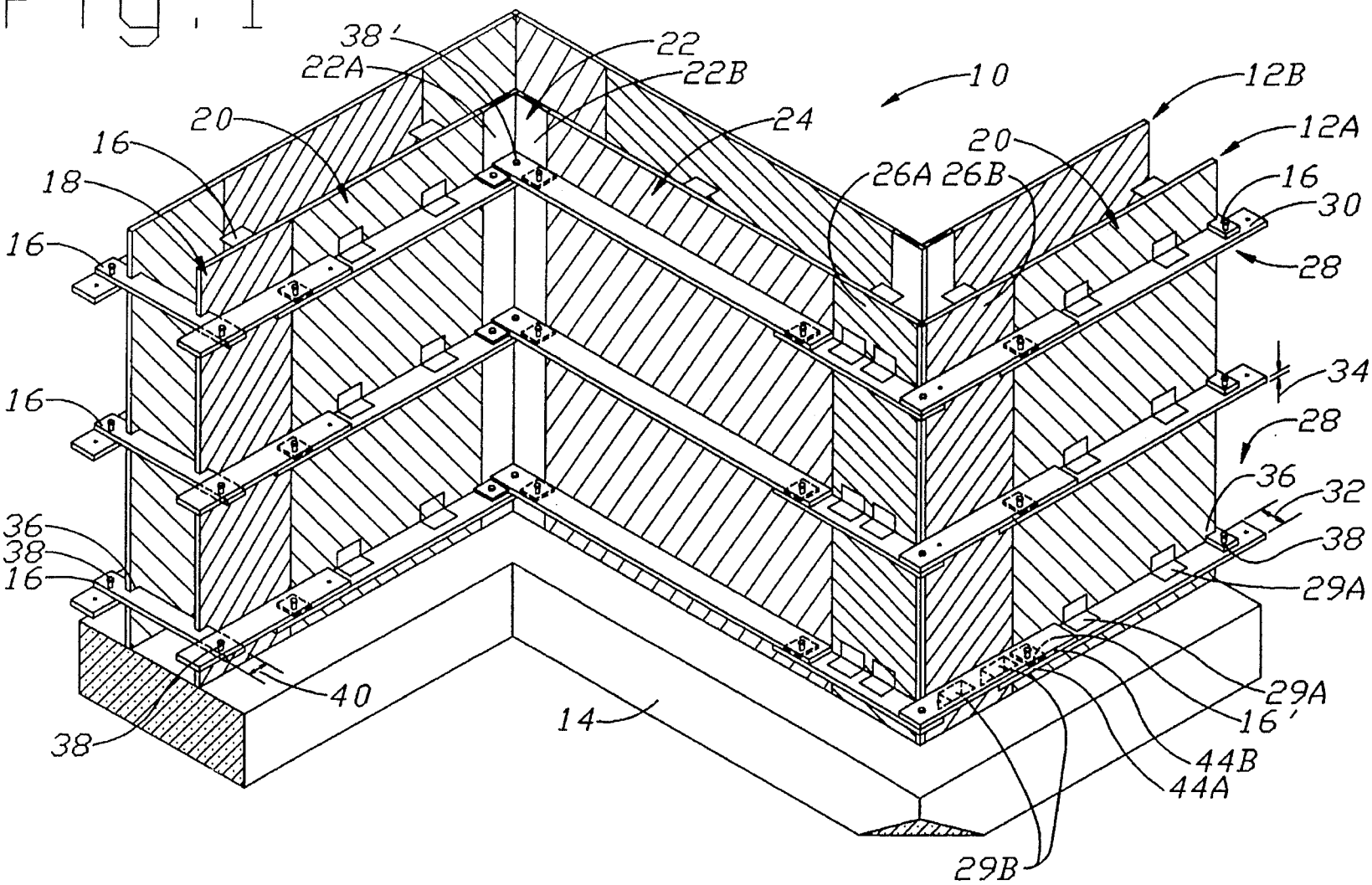
FIG. 1 is a perspective view of a concrete wall form constructed with the preferred embodiment of the concrete wall form assembly of the present invention.
Figure 2:
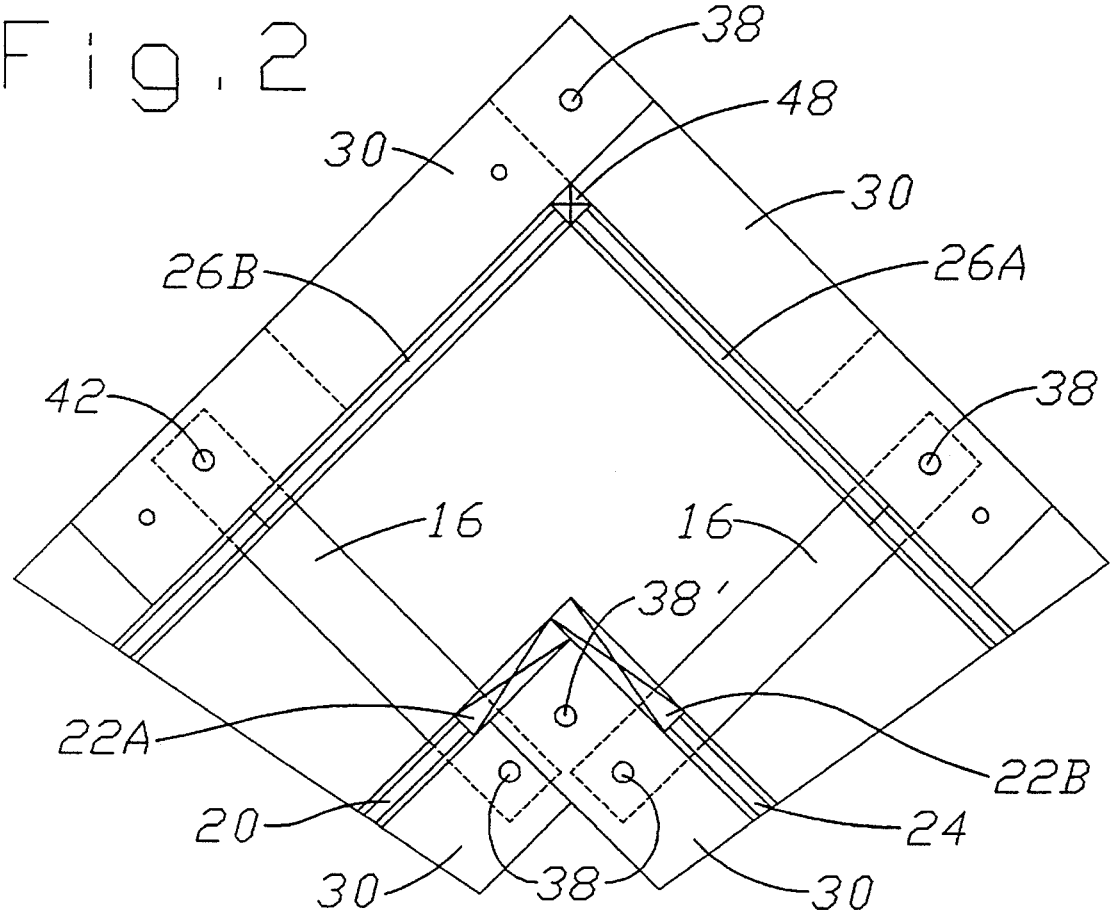
FIG. 2 is a relatively enlarged plan view of a corner section of the concrete form wall of FIG. 1.
Figure 3:
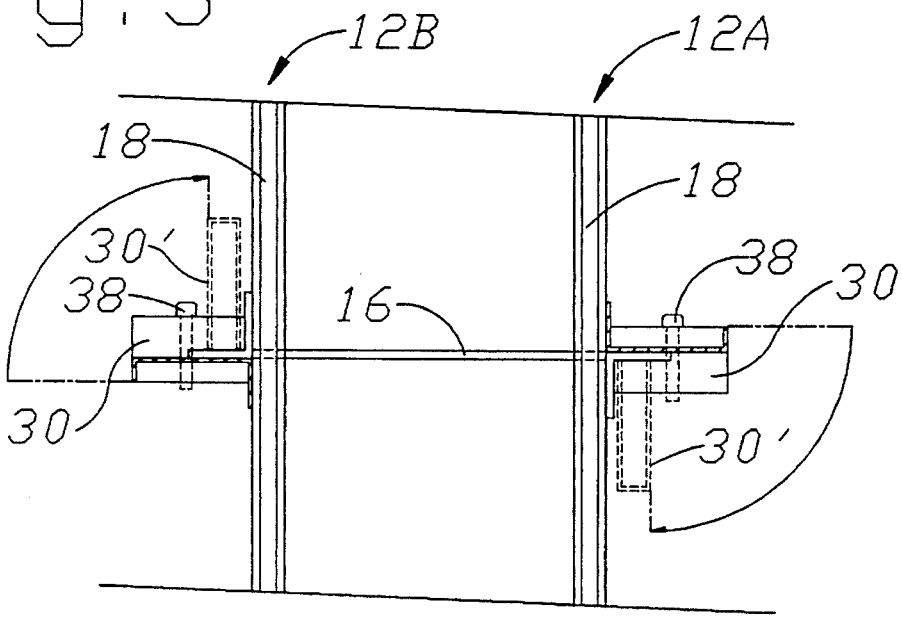
FIG. 3 is a sectional side view of two opposed form walls of FIG. 1.

Referring now to FIG. 1, a concrete wall form section 10 constructed in accordance with the present invention has a pair of parallel, spaced, opposed wall assemblies 12A and 12B mounted on a suitable hardened concrete footing 14. The opposed wall assemblies 12A and 12B are held together by means of a plurality of substantially interconnecting ties, or cross members, 16, preferably made of metal or other material sufficiently strong to resist the forces of hydrostatic pressure from the concrete (not shown) when poured between the wall assemblies 12A and 12B, as best seen in FIGS. 1–3. The concrete wall form section 10 is joined together with other sections (not shown) in end to end abutment to form a closed loop and contained space within which is poured premixed concrete. Alternatively, a suitable end cap (not shown) is placed over the open ends and held in place by pin connections with overlapping cross braces in a manner described below with reference to the various form walls which are assembled in end to end abutment to build the form wall assemblies 12A and 12B. After the concrete has hardened sufficiently to be self supporting, the walls 12A and 12B are disassembled, the cross members 16 are left permanently in the concrete wall, and the ends of the cross member protruding from the concrete wall are removed.

Each of the opposed form wall assemblies 12A and 12B are made of a plurality of five different types of form walls: a short form wall 18, a medium form wall 20, an inside corner form wall 22, a long form wall 24 and outside corner form walls 26A and 26B, which are interconnected in various combinations to build walls of various shapes. All of these form wall assemblies have common characteristics. Each of the form walls 18–26B is made from a rectangular, planar panel, preferably made of ¾" thick BB grade plywood with a high density face on both sides. Each of the form walls 18–26B has a brace assembly 28, such as medium form wall 20, comprised of a plurality of elongate, parallel cross braces, or braces, 30 which are mounted to the exterior surface of the form wall. Preferably, they are mounted by means, such as hinges 29A of form wall 20 and reverse mounted, but otherwise identical hinges 29B of adjacent form wall 26B, shown in broken lines. The hinges enable movement of the braces 30 between a collapsed relatively low profile position for transport, as brace 30' shown in broken lines in FIG. 3, and an operative position for bracing the form wall, as shown in FIG. 1 and in solid lines in FIG. 3.

The number of braces which are required depends upon the height of the form wall 22. The braces 30 are preferably spaced from each other by one to two feet with the bottom most brace 30 located approximately six inches from the bottom of the form wall 22 where hydrostatic pressure is greatest and approximately one foot from the top where the hydrostatic pressure is least. The number of braces 30 which are employed depends upon the height of the form wall 22. In the four foot form wall shown in FIG. 1, only three braces 30 have been found adequate, while for an eight foot wall, for instance, as many as six parallel braces are employed.

Each of the braces has a width dimension 32 substantially greater than a thickness dimension 34. Accordingly, the braces 30 are more capable of resisting bending forces when in the operative position with the brace 30 extending to a greater extent from the exterior surface of the form wall 20 then when in the collapsed position. In the collapsed position, the width dimension 32 extends in a direction substantially transverse to the planar body of the wall form 20 to maximize the resistance of the brace against bowing of the form wall 20.

Another feature of each of the form walls 18–26B, such as intermediate form wall 20, is the provision of a plurality of open end slots 36 in the end of the form wall 20. These end slots 36 are respectively adjacently aligned with the plurality of braces 30 to provide supportive receipt for one of the cross members 16. An interlocking pin member 38 removably extends through a pin hole 76, FIGS. 5A–6B, in the exterior end portion of the cross member 16 received within slot 36. The pin member 38 releasably blocks removal of the cross member 16 from the slot 36 by outward pressure on the intermediate form wall 20. As best seen at the end of short form wall 18 of FIG. 1, pin members 38 block separation of the opposed form wall 18' located opposite form wall 18. In the preferred embodiment, the interlocking pin members 38 also pass through aligned pin openings in the braces 30 adjacent the slots 36. The rigidity of the cross members 16 in cooperation with the pin members 38 thereby prevent the opposed form wall assemblies 12A and 12B from moving toward each other to maintain needed structural integrity for self-support of the wall form assembly 10 prior to pouring. Advantageously, because the slots 36 are supportive of the cross member 16 during assembly, the braces of adjacent form walls need not be aligned to connect the cross member 16.

In keeping with another important aspect of the slots 36, the depth of the slots, or end slots, 36 into the ends of the form walls 18–26B is substantially equal to half of the width 40 of the cross members 16. The end slots 36 in the abutting ends of adjacent form walls 18–26B are aligned with each other to form a closed rectangular hole in the form wall assembly. Half the width 40 of a cross member 16 is supportively received in the aligned end slot 36 of one of the abutting form walls and the other half of the width is received within the aligned end slot. When the matching end slots 36 in adjacent form walls 18–26B are aligned sufficiently to enable receipt of a cross member 16, they are shown to be in correct vertical register. During assembly, the cross members 16 are inserted into and snugly supported between the aligned slots 36 of the parallel opposed form walls 18–26B to align and hold them in proper spaced relationship. While being held in spaced relationship, the abutting form walls 18–26B are moved into place with their end slots 36 fitting over the half the width 40 of the cross members which protrude from the end slots 36 of the stationary form walls. Advantageously, because these slots 36 are located at the abutting ends of adjacent wall forms, it is not necessary to have two persons on opposite sides of the form walls 18–26B of the opposed form wall assemblies 12A and 12B, as is required in known systems in which the tie member holes are located intermediate ends of the form walls. Also, advantageously, the cross members 16 are supportively held in the end slots 36 themselves independently of any connection or cooperation with the braces, so that the braces 30 need not be in an operative position to hold the cross members in place during assembly.

As seen in, and as will be explained in greater detail with reference to FIGS. 5A and 5B and 6A and 6B, each of the cross members 16 preferably has a pin hole 76 adjacent each of its opposite end portions through which passes the same pin 38 that passes through the pin holes of overlapping braces 30 to releasably interlock together the abutting form walls 18–26B, such as between abutting pairs of form walls 16 and 20, 20 and 22, 22 and 24, 24 and 26A, and 26B and 20. The adjacent wall forms, such as wall forms 26B and 20, preferably have their braces 30 mounted for opposite pivotal movement of the overlapping end portions 44A and 44B to sandwich therebetween the cross member 16, as seen at the juncture between form walls 26B and 20. The locking pin 38 extends through the pin holes in the end portions 44 as well as the pin hole 42, FIG. 2, of the end portions 16' therebetween to interlock the abutting ends of the form walls against separation. In addition, this interlocks the opposed wall forms in the correctly spaced relationship and assists in holding the braces 30 fixedly against the outside surfaces of the form walls.

The short, medium and long form wall assemblies 18, 20 and 24 are substantially identical to each other except for the widths of their plywood form walls 18, 20 and 24, respectively being one foot, two feet and three feet in length. All of the form walls 18, 20 and 24 have a plurality of pairs of aligned slots 36 in their opposite ends which are vertically located adjacent the plurality of elongate braces 30, respectively.

The elongate braces 30 are preferably skewed slightly relative to parallel alignment with the bottom of panels, so that one end of each brace at one end of each of the form walls 18, 20 and 24 is slightly higher than the opposite end of each brace at the opposite end of the form walls 18, 20 and 24. This is preferably done to facilitate overlapping of the portions of the elongate braces 30 which extend beyond the opposite ends of the form walls 18, 20 and 24.

Referring in detail to FIG. 2, the braces 30 of the form wall assemblies 18, 20 and 24 are hinged at their top and pivot downwardly to overlie the associated cross member 16, while the braces 30 of the form wall assemblies 18, 20 and 24 on the other side of the wall form assembly 10 are hinged at their bottom to pivot upwardly to underlie the associated cross member 16. After each cross member 16 is aligned and sandwiched between the associated overlapping elongate braces 30, the pin member 38 which pass through all this, releasably interlocks them together.

Referring to FIG. 2, the two form wall assemblies 26A and 26B which are interconnected to form an outside corner are substantially the same as the form walls 18, 20 and 24 except slots are only provided at one end of the plywood panel which is spaced from the corner. A corner piece 48 is inserted between the abutting inside ends of form walls 26A and 26B to ensure a good seal since only the edges abut. The braces 30 on form walls 26A and 26B are oppositely hinged to overlap each other adjacent to the corner piece 48 and are interlocked by a pin member 38. The opposite ends of the braces 30 of corner form walls 26A and 26B are then interlocked with the braces 30 connected to other form walls, such as form walls 24 and 30, respectively.

The inside corner form wall assembly 22 has two panels 22A and 22B which are secured together along their length by suitable right angle brackets (not shown), or, preferably, by screw fasteners and adhesive. In keeping with one aspect of the invention, the widths of the inside corners are substantially equal to the distance that each of the end portions of the braces 30 extends beyond their associated form wall. The ends of the panels 22A and 22B have slots 36 in their ends aligned with the braces 30 of adjacent form walls 20 and 24 and support cross member 30 therein. The braces 30 of abutting form walls 20 and 24 overlap at the inside corner formed by panels 22A and 22B and are then interlocked with a pin member 38' which unlike all the other pin members 38 does not pass through a cross member 16 also. Instead, two separate pin members 38 interlock the cross member 16 of panel 22A with the cross member 30 of the form wall 20 and the cross members 16 of panel 22B with the cross members of the form wall 24. Thus, the inside corner form wall is releasably interlocked in place without the need for any separate brackets or other connectors being permanently mounted to the inside corner form wall 22 which would disadvantageously increase its weight. Because of the relatively short width of panels 22A and 22B of the inside corner form wall 22, there is no need to disassemble panels 22A and 22B for transport, and they are preferably permanently attached to each other by adhesive, screws or other like fastenings.

Figure 4A:
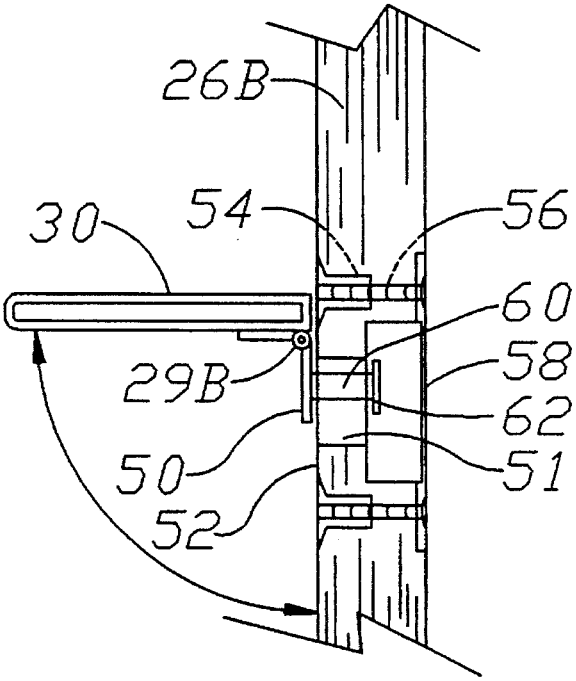
FIG. 4A is a sectional side view of a preferred assembly for collapsible mounting of the elongate braces to the form wall of FIG. 1.

Referring to FIG. 4A, preferably in order to ensure a secure attachment of the hinges, such as hinge 29B, attached to form wall 26B, a hinge plate 50 is secured to a larger mounting plate 52 which is counter-sunk into the outer surface of panel 26B and, in turn, fastened by suitable mating metal screw fasteners 54 and 56. Fastener 54 is an internally threaded post fixedly attached to plate 52 and used to receive externally threaded bolts which mount a plate 58 that is counter-sunk into the inside surface of form wall 26B. Another pair of mating screw fasteners 60 and 62 like screw fasteners 54 and 56, respectively, are used to fasten the hinge plate 50 to a vertical adjustmen slot 51 of the mounting plate 52.

Figure 4B:
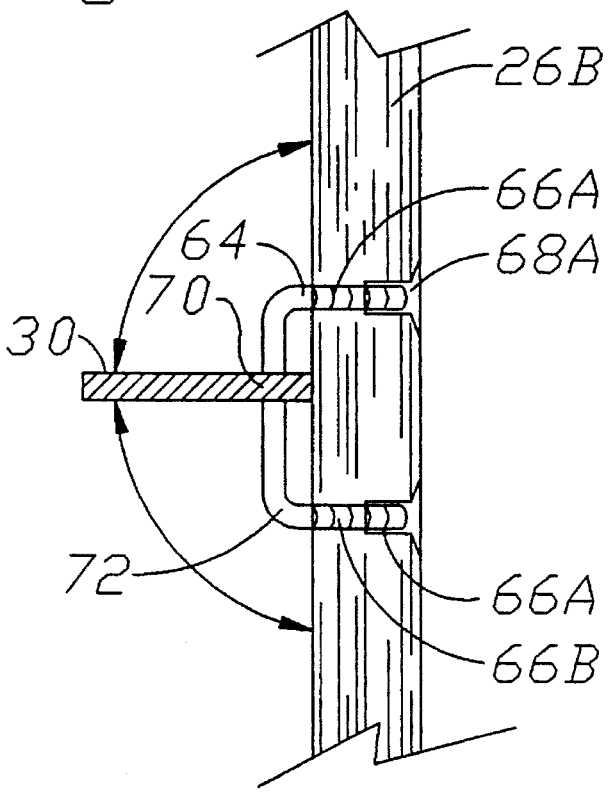
FIG. 4B is an alternative embodiment of a mounting assembly for collapsible mounting of an elongate brace to the form wall of FIG. 1.
Figure 5A:
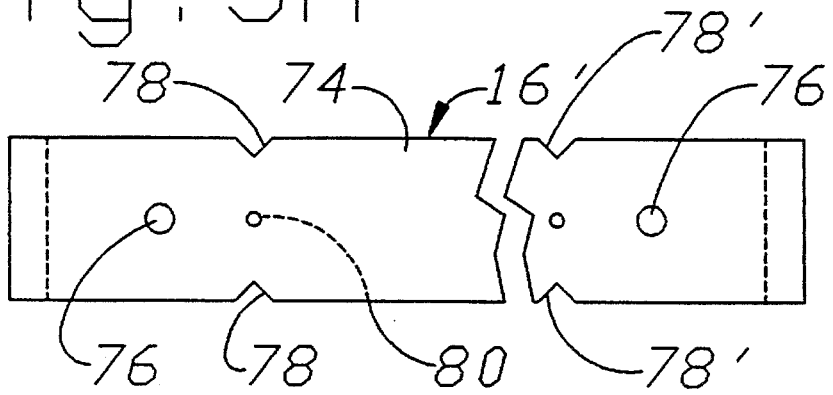
FIGS. 5A and 5B are plan and side views, respectively, of a preferred form of the cross members of FIGS. 1–3.
Figure 5B:
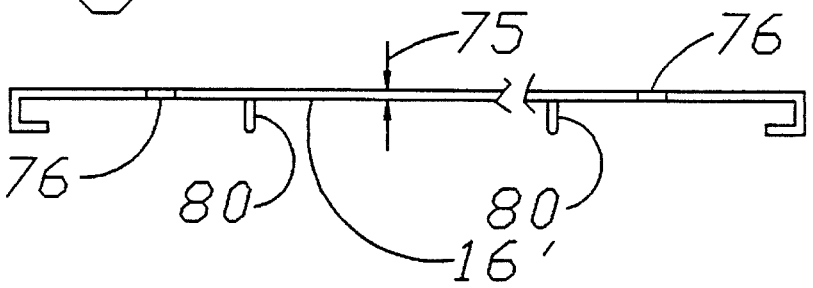
Figure 6A:
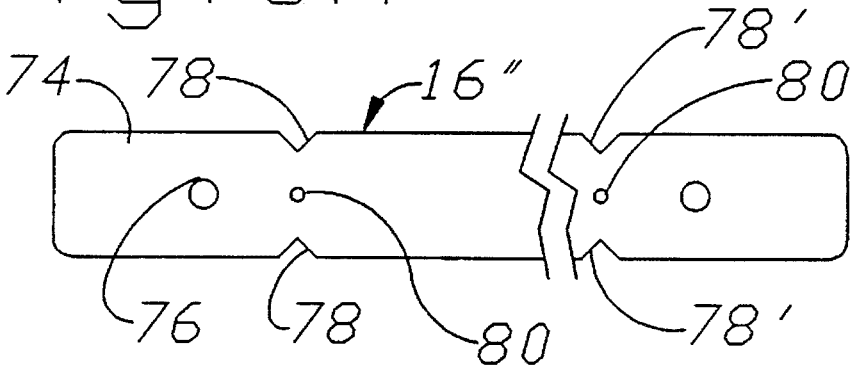
FIGS. 6A and 6B are plan and side views, respectively, of another form of the cross member employable in the wall form assembly of FIGS. 1–3.
Figure 6B:
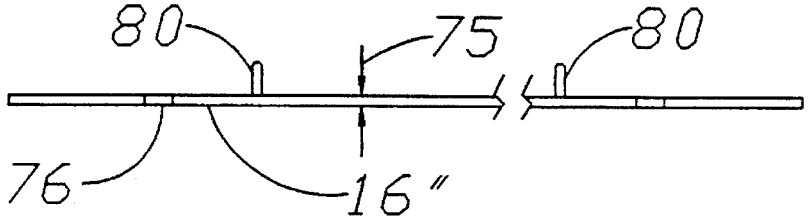

Referring to FIG. 4B, an alternative means for movably mounting the brace 30 without a hinge is shown in which the brace 30 is mounted to a generally U-shaped bracket 64. The opposed legs 64A and 64B are externally threaded for fastening to a form wall, such as form wall 26B. Advantageously, with this U-shaped movably mounting assembly, a degree of vertical movement is enabled to facilitate overlapping of the braces 30 without the need for canting the alignment of the mounting assemblies relative to the bottom edge of the form wall, as with the hinge connector. In addition, of course, the brace 30 which receives the U-shaped mounting bracket 64 through a mounting hole 70 can also be pivoted around either curved end, such as lower curved end 72 of the U-shaped bracket to move it to a collapsed, low profile position lying against the outside surface of the form wall 26B.

Referring now to FIGS. 5A and 5B and 6A and 6B, two different types of cross members 16' and 16" are shown. Both cross members 16' and 16" have an elongate relatively thin body 74 made of a suitable metal or plastic. The length of course depends upon the separation between the wall assemblies 12A and 12B, but a thickness 75 of approximately 1/16 inch has been found suitable for a cross member made of metal such as aluminum. Both cross members 16' and 16" also have a pair of pin holes 76 at opposite ends as noted previously with reference to FIG. 1 for receipt of pin member 38 and a pair of opposed side notches 78 and 79 and spreader posts 80. The spreader posts 80 are located on the outside of the wall form assembly 10 to assist the braces 30 in blocking separation of the form wall assemblies 12A and 12B by blocking sliding longitudinal movement of the wall end slot 36 beyond the ends of the slots 36. The pairs of opposed notches 78 and 79 are located adjacent the outside surface at the edge of the end slot 36 to preweaken the body between the opposed pairs to facilitate breaking off the end portion 82 and 84 after the concrete has hardened and the wall form assembly 10 is removed. When the end portions are bent back and forth relative to the body 16' and 16" intermediate the spreader posts 80, because of the preweakening between the opposed pair of notches 78 and 79, the body wall bends along the preweakening bend line between the notches. By bending the end portions back and forth along the preweakened bend line, the body can be fatigued along the bend line until it can be broken off.

Figure 7A:
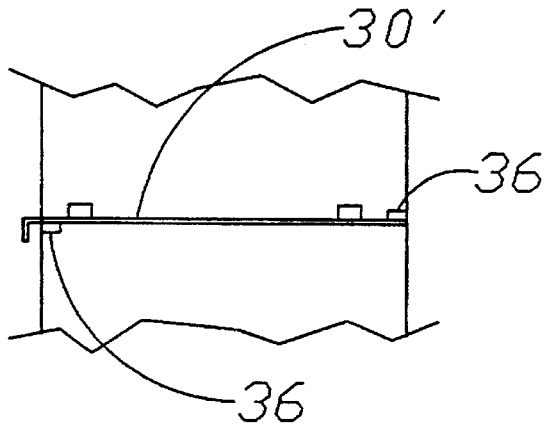
FIGS. 7A and 7B are side views of enlarged side views of another embodiment of the brace assembly in which the pins are carried by the braces to prevent loss of the locking pin.
Figure 7B:
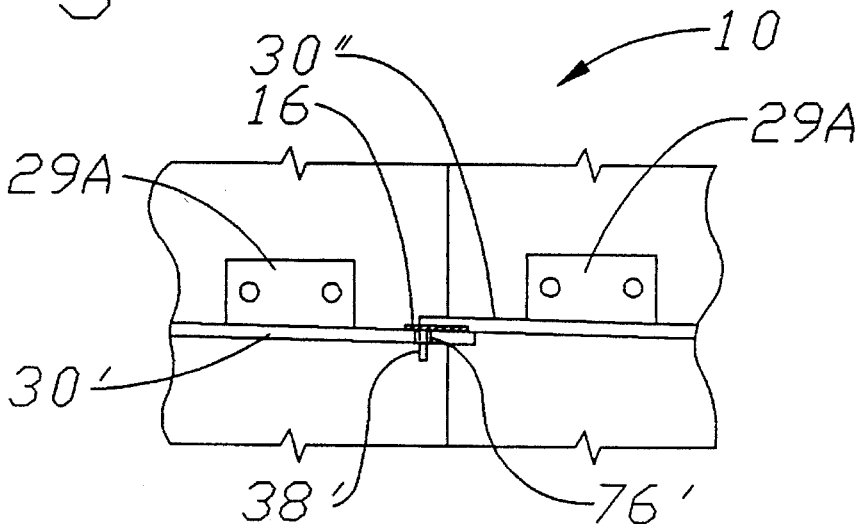

Referring now to FIGS. 7A and 7B, an alternative embodiment of the wall form assembly invention is illustrated in which instead of the removable pins 38 being employed to interlock adjacent pivotally mounted braces 30', a pin member 38 is fixedly attached to one end of each brace 30' for receipt within a pin hole 76' at the end of a brace 30' of an abutting form wall 18–26B. Advantageously, this eliminates the potential of loss of the locking pins 38 but, of course, does so at the expense of increasing the weight of the form walls 18–26B.

Figure 8A:
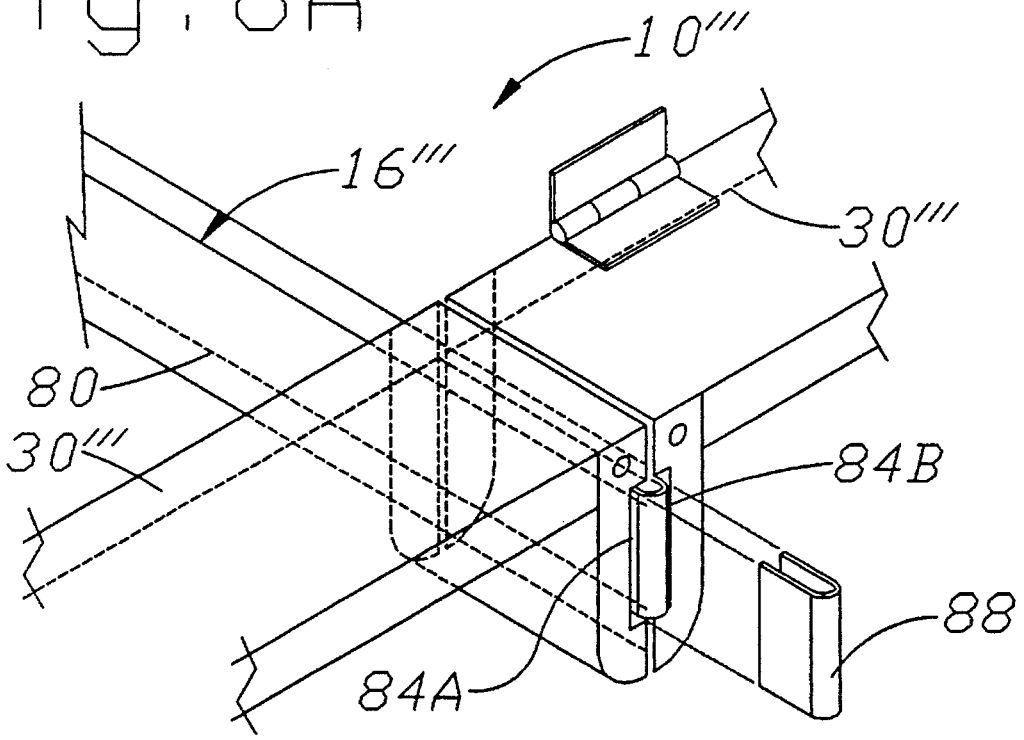
FIGS. 8A and 8B are perspective and side views of another embodiment of the wall form assembly in which an I-shaped cross member is trapped between a pair of connectors preferably mounted at the ends of abutting braces.
Figure 8B:
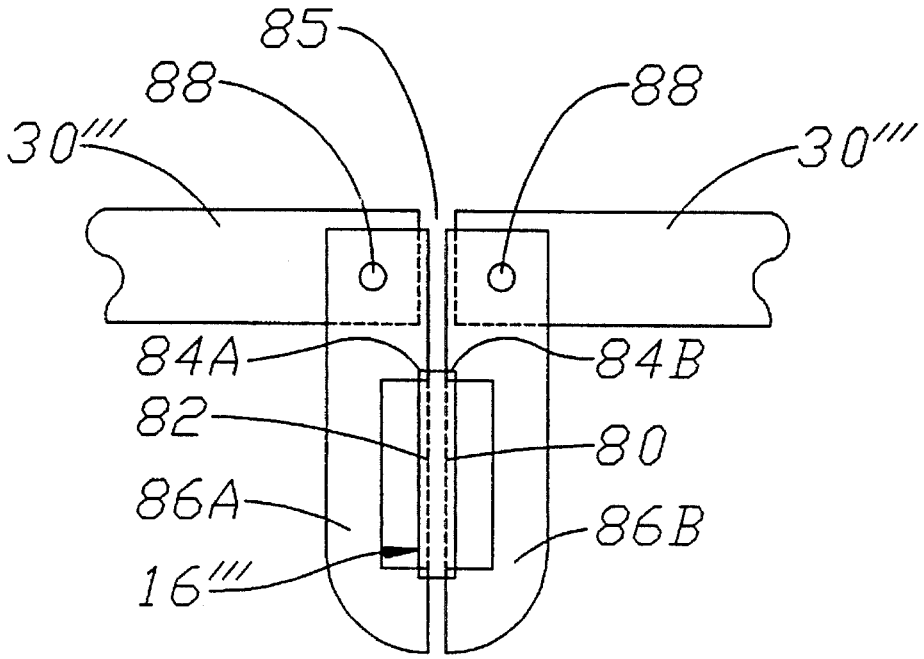

Referring now to FIGS. 8A and 8B, another embodiment of the invention 10''' is shown in which a different assembly is used to interlock abutting braces 30''' with the cross members 16'''. Cross members 16''' are shaped like an I, being T-shaped at their opposite ends. An elongate body stem 80 extends between a pair of opposite cross bars 82 (only one shown). This cross bar 82 fits over opposed vertical shoulders 84A and 84B (only one shown) on opposite sides of a slot 85 between mating connectors 86A and 86B. Mating connectors 86A and 86B are pivotally mounted to the ends of braces 30''' by pivot axles 88. The mating connectors have a pair of slots on opposite sides of the vertical shoulders 84A and 84B for receipt of a C-clamp 88, FIG. 8A, which when inserted in mating slots, holds the two mating connectors in operative engagement with each other, as shown in FIG. 8B, and thus in operative engagement with shoulders 84A and 84B. In such case, the cross bar 82 blocks the sliding removal of the cross member 16''' from between the mating connectors 86A and 86B. As with the embodiment of FIG. 1, preferably the braces 30''' are mounted for movement between the operative position as shown in FIGS. 8A and 8B by means of hinges 29A or the movable mounting assembly of FIG., 4B to an inoperative position, low profile position illustrated in FIG. 3.

Figure 9:
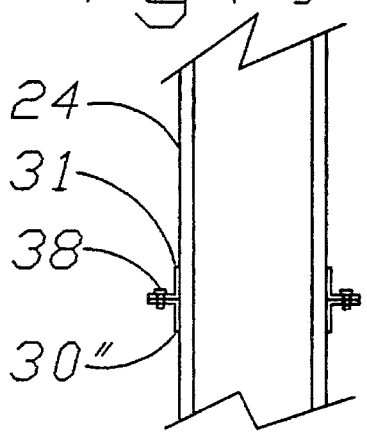
FIG. 9 is an end view of another form of the braces in which they are provided with an L-shape and are fixedly attached to the form wall.

Referring to FIG. 9, another embodiment of the wall form assembly 10" is shown in which the braces 30" are cross sectionally L-shaped and fixedly, instead of movably, attached to their associated plywood form walls 18–26B by means of suitable screw fasteners 31. This is contemplated for use with the braces 30" made of material stronger than aluminum in which the relatively low profile of the L-shaped cross sectional braces does not substantially interfere with stacking for storage or transport. Also, the advantages of having a brace with a wider dimension transverse to the plane of bowing force than its thickness is obtained. The L-shaped braces 30" are attached by suitable fasteners such as shown for fastening the large plate 50 to the form wall 26B in FIG. 4A.

While a detailed description of the preferred embodiment of the invention has been given, it should be appreciated that many variations can be made thereto without departing from the scope of the invention as set forth in the appended claims.

I claim:

1. In a concrete wall form assembly having a form wall with interior and exterior surfaces, the improvement being a brace assembly, comprising:

an elongate brace; and means for mounting the brace along the exterior surface of the form wall for movement between a collapsed position for transport and an operative, high profile position relative to the collapsed position for bracing the form wall.

2. The concrete wall form assembly of claim 1 in which the mounting means includes means for pivotally mounting the brace for pivotal movement between the collapsed position and the operative position.

3. The concrete wall form assembly of claim 2 in which the pivot mounting means includes a hinge secured to the elongate brace and to the form wall.

4. The concrete wall form assembly of claim 3 including another form wall with another elongate brace with an extension for overlapping with the brace of the one form wall and a hinge for mounting the other brace to the other form wall for movement between collapsed and operative positions, the hinge of one of said walls being mounted to a top surface of the associated brace and the hinge of the other of said walls being mounted to the underside of the associated brace.

5. The concrete wall form assembly of claim 2 in which the pivotal mounting means includes a bar secured to the form wall to form a closed loop for slidably mounting the elongate brace for movement between the collapsed position and the operative position.

6. The concrete wall form assembly of claim 1 in which the form wall has an end and the elongate brace has an end portion that extends beyond the end of the form wall to interconnect with a brace of another form wall.

7. The concrete wall form assembly of claim 6 in which the end portion has a pin hole for pinned connection with a brace of another form wall.

8. The concrete wall form assembly of claim 6 including a cross member sandwiched between the end portion and the brace of the other wall.

9. The concrete wall form assembly of claim 8 in which the each of the form walls has an end slot adjacent an associated on of the braces for receipt of the cross member.

10. The concrete wall form assembly of claim 1 in which the form wall has an end, and the braces has an end adjacent the end of the form wall and carries means for interconnecting the end of the brace to another brace of another form wall.

11. The concrete wall form assembly of claim 1 in which the brace has a width dimension and a thickness dimension less than the width dimension, and said mounting means mounts the brace to the wall for movement to a position in which the width dimension of the brace extends substantially transversely from the form wall for maximum resistance against bowing of the form wall when in the operative position.

12. The concrete wall form assembly of claim 11 including means for blocking the brace against further movement away from the collapsed position after being moved to the operative position with the width of the brace extending substantially transversely of the form wall.

13. In a concrete form wall assembly having a form wall with an end and interior and exterior surfaces, the improvement being a cross bar assembly, comprising:

an open slot in the end of the form wall for snug supportive receipt of a cross member; and means including an interlocking member adjacent to the open slot in the end of the form wall and on the exterior surface of the form wall for releasably preventing removal of the cross member from the slot including a pin member for passing through the cross member, and a brace member for reinforcing the form wall and having a pin hole for receipt of the pin member to interlock the brace member with the cross member.

14. In a concrete form wall assembly having a form wall with an end and interior and exterior surfaces, the improvement being a cross bar assembly, comprising:

an open slot in the end of the form wall for snug supportive receipt of a cross member; and means including an interlocking member adjacent to the open slot in the end of the form wall and on the exterior surface of the form wall for releasably preventing removal of the cross member from the slot including an elongate brace mounted along the exterior surface of the form wall and having a pin receiving opening, the cross member having a pinhole, and the elongate brace having the pin receiving opening at a location alignable with the cross member pinhole when snugly received within the open slot.

15. The concrete form wall assembly of claim 14 in combination with a pin inserted through the cross member pinhole and the elongate brace pin receiving opening to interlock and cross member with the elongate brace.

16. A concrete wall form assembly, comprising:

a form wall having an exterior surface and a pair of spaced opposite ends;

an elongate brace member having a length substantially greater than the spacing between the opposite ends; and means for permanently mounting the brace member to the exterior surface with an end portion extending beyond at least one of the opposite ends for interconnection with a mounting brace of another form wall assembly including means for mounting the brace member for movement between a collapsed position for transport and an operative position for interconnection with the mounting brace of another form wall assembly.

17. A concrete wall from assembly, comprising:

a form wall having an exterior surface and a pair of spaced opposite ends;

an elongate brace member having a length substantially greater than the Spacing between the opposite ends;

means for permanently mounting the brace member to the exterior surface with an end portion extending beyond at least one of the pair of spaced opposite ends of the form wall for solely overlapping, substantially coextensive engagement with a like end portion of a mounting brace of another form wall assembly; and means for interconnecting a cross member disposed between the form wall and another form wall to the end portion of the brace member.

18. The concrete wall form assembly of claim 17 in which said interconnecting means includes means for overlapping interconnection of said end portion of the brace member with said end portion of said mounting brace of said other form wall assembly, including a pair of holes passing through the end portion of the brace member and said mounting brace respectively, for receipt of an interconnecting pin.

19. The concrete wall form assembly of claim 18 in which said overlapping interconnection means includes a pin hole in said cross member alignable with the pair of holes for receipt of the interconnecting pin.

20. A form wall assembly for construction of a concrete wall form, comprising:

a planar body;

a plurality of elongate braces having width dimensions greater than thickness dimensions; and means including an L-shaped member for mounting the braces to the body with their width dimensions extending in a direction substantially transverse to the planar body, the mounting means includes means for mounting the braces for movement between one position in which their width dimensions extend in a direction substantially parallel to the planar body and another position in which their width dimensions extend in a direction substantially transverse to the planar body to maximize resistance against bowing.

21. In a concrete wall form assembly having a form wall with an exterior surface and substantial straight bottom edge, the improvement being a brace assembly, comprising:

an elongate brace carrying a fixedly attached transverse locking pin member at one end and a pin receiving hole at an opposite end; and means for mounting the elongate brace to the exterior surface in substantially parallel relationship to the bottom edge.

22. The concrete wall form assembly of claim 21 in which the mounting means includes means for mounting one end slightly higher than the other end of the brace to facilitate overlapping interconnection with another brace.

23. In a concrete wall form assembly having a form wall with an exterior surface and substantial straight bottom edge, the improvement being a brace assembly, comprising:

an elongate brace carrying a transverse locking pin member at one end and a pin receiving hole at an opposite end; and means for mounting the elongate brace to the exterior surface in substantially parallel relationship to the bottom edge including means for mounting the brace for movement from an inoperative position to an operative position in which the locking pin member extends in a direction substantially parallel to the exterior surface of the form wall.

* * * * *

UNITED STATES PATENT AND TRADEMARK OFFICE

CERTIFICATE OF CORRECTION

PATENT NO. : 5,456,444

DATED : October 10, 1995

INVENTOR(S) : Paul R. Wegman

It is certified that error appears in the above-indentified patent and that said Letters Patent is hereby corrected as shown below:

Col. 3, line 37, change "digital" to - distal -;

Col. 10, line 60, before "each" delete - the -;

Col. 10, line 61, after "associated" change "on" to - one -;

Col. 10, line 64, after "the" (first occurrence) change "braces" to - brace -; and Col. 11, line 46, after "interlock" change "and" to - the -.

Signed and Sealed this

Seventh Day of January, 1997

*Attest:*

Bruce Lehman

BRUCE LEHMAN

*Attesting Officer*

*Commissioner of Patents and Trademarks*